US007159626B2

(12) United States Patent
Biller et al.

(10) Patent No.: US 7,159,626 B2
(45) Date of Patent: Jan. 9, 2007

(54) MULTI-APPLICATION WOOD WORKING KNIFE AND CLAMPING ASSEMBLY

(75) Inventors: Sven-Olov Biller, Hudiksvall (SE); Mathieu J. A. Gouin, Westbank (CA); Daniel M. LaGrange, Kelowna (CA); Christian Plouffe, Laval (CA); Ian G. Zinniger, Ste-Therese (CA)

(73) Assignee: Iggesund Tools AB, Iggesund (SE)

( * ) Notice: Subject to any disclaimer, the term of this patent is extended or adjusted under 35 U.S.C. 154(b) by 0 days.

(21) Appl. No.: 10/293,309

(22) Filed: Nov. 14, 2002

(65) Prior Publication Data

US 2003/0131907 A1 Jul. 17, 2003

(51) Int. Cl.
*B27C 1/00* (2006.01)
*B27G 13/08* (2006.01)
*B26D 1/14* (2006.01)

(52) U.S. Cl. ..... 144/176; 144/220; 144/230; 407/40; 407/42; 407/49; 241/92

(58) Field of Classification Search ..... 144/373, 144/162.1, 172, 174, 176, 218, 220, 221, 144/230, 235, 241; 241/92, 278.1, 292.1, 241/296, 298; 407/40, 42, 47, 49, 107, 111
See application file for complete search history.

(56) References Cited

U.S. PATENT DOCUMENTS

| | | | | | |
|---|---|---|---|---|---|
| 3,981,337 | A | * | 9/1976 | Sundstrom | 144/241 |
| 4,047,670 | A | | 9/1977 | Svensson | 241/92 |
| 4,271,882 | A | | 6/1981 | Valo | 144/241 |
| 4,423,758 | A | | 1/1984 | Haller et al. | 144/176 |
| 4,503,893 | A | | 3/1985 | Demopoulos | 144/176 |
| 4,610,285 | A | | 9/1986 | Derivaz | 144/231 |
| 4,669,516 | A | | 6/1987 | Carpenter et al. | 144/241 |
| 4,771,718 | A | | 9/1988 | Carpenter et al. | 144/176 |
| 4,784,337 | A | | 11/1988 | Nettles et al. | 241/92 |
| 4,850,408 | A | | 7/1989 | Carpenter et al. | 144/241 |
| 4,887,772 | A | | 12/1989 | Robinson et al. | 241/92 |
| 4,977,939 | A | | 12/1990 | Depay et al. | 144/176 |
| 4,997,018 | A | | 3/1991 | Carpenter et al. | 144/241 |
| 5,129,437 | A | | 7/1992 | Nettles et al. | 144/176 |
| 5,133,394 | A | * | 7/1992 | Landtwing | 144/230 |
| 5,271,440 | A | * | 12/1993 | Bradstreet et al. | 144/176 |
| 5,274,899 | A | | 1/1994 | Sentagnes et al. | 29/468 |
| 5,305,811 | A | | 4/1994 | Schaefer | 144/176 |
| 5,348,064 | A | | 9/1994 | Nettles et al. | 144/176 |
| 5,409,047 | A | * | 4/1995 | Jorgensen | 144/176 |
| 5,439,039 | A | * | 8/1995 | Bradstreet et al. | 144/220 |
| 5,469,902 | A | | 11/1995 | Sharp et al. | 144/241 |

(Continued)

FOREIGN PATENT DOCUMENTS

CA 2307408 11/2001

*Primary Examiner*—Lowell A. Larson
*Assistant Examiner*—Shelley Self
(74) *Attorney, Agent, or Firm*—Fitzpatrick, Cella, Harper & Scinto

(57) ABSTRACT

A wood working knife for use in a wood working machine, comprising a knife body having a first cutting edge and an opposed second cutting edge, the knife body having a first clamping surface and a second clamping surface. The first clamping surface has opposed clamping features separated by a middle section, the opposed clamping features and the middle section being sized and shaped such that, upon the knife body being inserted into a clamping assembly, the clamping forces are localized towards the opposed cutting edges and away from the middle section.

76 Claims, 4 Drawing Sheets

U.S. PATENT DOCUMENTS

| | | | | |
|---|---|---|---|---|
| 5,501,256 | A | 3/1996 | Dyer et al. | 144/241 |
| 5,505,239 | A | 4/1996 | Sparks | 144/220 |
| 5,564,967 | A | 10/1996 | Jorgensen | 451/45 |
| 5,575,320 | A | 11/1996 | Brisson | 144/220 |
| 5,613,538 | A | 3/1997 | Brisson | 144/228 |
| 5,623,977 | A | 4/1997 | Sparks | 144/220 |
| 5,649,579 | A | 7/1997 | Kokko et al. | 144/176 |
| 5,660,218 | A | 8/1997 | Jonkka | 144/176 |
| 5,765,452 | A | 6/1998 | Roux et al. | 76/115 |
| 5,819,826 | A | 10/1998 | Schmatjen | 144/241 |
| 5,820,042 | A | 10/1998 | Robison | 241/92 |
| 5,896,902 | A | 4/1999 | Maybon | 144/329 |
| 5,906,231 | A | 5/1999 | Rautio | 144/241 |
| 6,056,030 | A | 5/2000 | Jonkka | 144/176 |
| 6,058,989 | A | 5/2000 | LaGrange et al. | 144/218 |
| 6,502,609 | B1 | 1/2003 | Guels | 144/176 |
| 6,591,878 | B1 | 7/2003 | Hinchliff | 144/241 |
| 2003/0019543 | A1 | 1/2003 | Schuh et al. | |

* cited by examiner

MULTI-APPLICATION WOOD WORKING KNIFE AND CLAMPING ASSEMBLY

FIELD OF THE INVENTION

This invention relates generally to the forestry industry, and more specifically to the field of wood working machines of the type that are used to process wood to form chips or wafers for pulp or waferboard production, to form rough or finished lumber, or to form veneer for the production of plywood or laminated veneer lumber. Most particularly, this invention relates to wood working knives used in such machines, and to clamping assemblies to hold the knives in place.

BACKGROUND OF THE INVENTION

Wood is an important natural resource that is used in many of today's modern products. Within the forest industry, trees are harvested, cut into logs, and then subsequently undergo various processes to transform the logs into finished products. For example, in the pulp or oriented-strand board industries, the logs are passed through a machine which turns the solid log into chips or wafers. Such machines are typically referred to as chippers, which may be in a disc or a drum form, and waferizers or stranders, which can also take a number of forms.

Within the sawmill industry, it is common for logs or semi-manufactured lumber to be passed through machines which chip away the outside portions of the wood being processed to form rough lumber and a multitude of wood chips. Such machines are commonly referred to as chipper canters, chipper edgers and chipper slabbers, each of which can take a variety of different forms. Typically, this rough lumber is then processed by planers to yield finished lumber having a smooth cut surface and wood shavings as a by-product.

Within the veneer industries, logs are turned on lathes to form veneer sheets that are subsequently used for the manufacturing of plywood or laminated veneer lumber. Such machines are commonly referred to as veneer lathes.

Typical of planers, chippers, waferizers and other such wood processing machines is that they carry a number of knives mounted to a moving base, such as, for example, a rotating disc or drum. The wood being processed is moved into the path of the rotating knives and the blade contacts the wood at a depth and orientation that results in the formation of wood chips, shavings, wafers, or strands. With chipper edgers, chipper canters, planers, or other similar wood finishing devices, the knives are also appropriately positioned so as to result in the formation of a cut or planed surface on the wood being worked. With veneer lathes however, the knife remains relatively stationary while the log, rotated about its axis, is engaged by the knife.

Common to all the aforementioned machines is that the repetitive contact between the cutting edge of the knife and the wood causes the cutting edge to wear and become dull over time. When the knife becomes too dull, it ceases to cut the wood cleanly and effectively. For example, in chippers, waferizers, and veneer lathes, a dull knife results in chips, wafers, or veneer of reduced quality and/or inconsistent size. In chipper canters, edgers, slabbers, or other like machines where rough or finished lumber is produced, knife sharpness influences the quality and accuracy of the finish of the wood being processed.

Traditionally, the method for maintaining knives sharp in the machines has been to remove the knife from the knife clamping assembly within the machine, sharpen the knife by regrinding it, and then replace the knife in the clamping assembly. However, this approach suffers from a number of known limitations. During each regrinding, portions of the knife must be ground away to create a fresh sharp cutting edge. This regrinding results in a change in size of the blade that if left unadjusted, would result in an altered location of the cutting edge after each regrinding. Specifically, the position of the cutting edge is altered relative to the features that locate the knife in the clamping assembly.

The result is that the position of the cutting edge can be displaced from its desired and intended location relative to the wood being worked or important associate components within the machine such as anvils and guide plates. Unless the position of the knife is adjusted in the clamping assembly each time, which is difficult to do accurately and is also time consuming, the performance achieved with the machine is degraded, sometimes to unacceptable levels. For example, with chipper canters, a precise positioning of the face or finishing knives relative to the wood being processed is a requirement for an accurate cut surface. Relatively small deviations in position can have a measurable impact on the quality of the finish achieved.

Another limitation of this approach is that the grinding may not be sufficiently precise. Equipment utilized within wood processing facilities is often such that accurate form (shape and angle) of the cutting edge cannot be maintained. Furthermore, during the on-site regrinding, the knives are sometimes damaged, whether through overheating or other grinding process irregularities. This can reduce the quality of the cutting edge causing the knife to wear faster degrading performance. Similarly, deviations in the form of the cutting edge can also result in a reduction in performance.

To overcome such problems, it has become common to use disposable blades, most often of a reversible, or double-edged, design. Such a knife is shown, for example, in U.S. Pat. No. 4,047,670 issued Sep. 13, 1977 to Aktiebolaget Iggesunds Bruk. The knife is essentially a planar, elongate body with one cutting edge running along one side of the elongate body and a second cutting edge running along the other. The knife is mounted in a knife clamping assembly that is sized and shaped to secure the blade during operation and allow for easy and rapid knife changes. In use, when the first cutting edge becomes dull, the knife is reversed and the second cutting edge is presented and used. When that cutting edge has also become worn, the knife is disposed of and replaced with a new one having two more fresh cutting edges.

With disposable designs, the problems relating to the grinding of the knife are eliminated because the knives are not reground. The dimensions and form of the knife, controlled by the knife manufacturer, remain unaltered between changes. There is also a certain gain in efficiency, because the smaller lightweight disposable blades, typically of higher quality materials and manufacture, allow for increased run times between changes. Also, because of the ease of replacing and rotating the knives, machine stoppages for knife maintenance is further reduced.

However, this solution also has some drawbacks. In some applications, the amount of cutting edge wear that affects performance can be quite minimal. Under such circumstances, the amount of regrinding that is required to restore the cutting edge is quite small such that the edge may only need to be lightly refreshed. In these situations, many of the profiles of the disposable blades lack an efficient and cost-effective method for restoring the cutting edge without significantly altering the shape and position of the cutting edge upon reinstallation into the clamping assembly.

Another problem that affects knives used in many types of wood processing machines is the difficulty in securing the knives in the clamping assemblies under the action of the cutting forces. The problem is most prevalent with disposable blade designs where the requirement for cost effectiveness and competitiveness mandates that the blades be compact and lightweight. Such compact blades are often difficult to secure in the clamping assembly such that they can resist the various types of loads encountered across the different types of applications. Chipping applications, for example, involve significant cutting forces directed towards the underside of the knife whereas with planers or waferizers, these cutting forces are relatively low. With chipper edgers and chipper canters, the face or finishing knives can often encounter significant loads directed to the topside of the cutting edge.

One particular problem that affects knife designs is the unsymmetrical nature of the loads distributed along the knife length. Wood is not a homogeneous material. Sometimes, the wood will exert a greater force against one localized area of the cutting edge than against the remainder of the blade. The most common reason for this is that the cutting edge strikes a knot or some other irregularity in the wood. Further, with some arrangements, one or both ends of the knife may utilized to produce a side cut. This can add to the non-symmetric nature of the loads encountered by the knife.

In such situations, twisting may occur. Typically, when the knife twists, the portion of the edge in contact with the irregularity bears a greater force. This difference in force along the length of the blade creates a torque on the knife which, if sufficiently large, can cause the knife to displace or twist in its mounting. A problem is to provide a knife and mounting assembly which is capable of handling such twisting forces.

Another consideration is the relationship between the design of the knives and their mountings, and the quality of the wood product they produce. Specifically, the quality of the end product is dependent on the accuracy of position of the cutting edge relative to the machine achieved during the initial installation, and subsequently, the ability to maintain the position when subjected to load. The greater the accuracy of the knife position, in general, the better the quality of the wood working results.

In most knife arrangements, knives are inserted into the clamping assembly by hand. Under such circumstances, precise positioning may be difficult, simply because the required precision may be greater than is possible in a manual operation. In many cases, the knives are changed in situations that are physically awkward for the person changing the knife. Depending on the circumstances, the person may need to reach overhead or around cumbersome components to perform the change. This renders precise positioning even more difficult.

Further, with many designs a range of position often exists within the clamping assembly in which the knife can be secured. This range of position, although often limited to a degree, allows for a variation in the location of the cutting edge relative to the wood being worked. One approach to overcoming this limitation is shown in U.S. Pat. No. 6,058,989 granted to Iggesund Tools AB. This approach is to employ a biasing element within the knife assembly itself to bias the knife into a predetermined position within the cassette to increase the accuracy of position of the cutting edge relative to the machine. However while helping to maximize the accuracy of position of the cutting edge during initial installation, this approach does not minimize the chances for subsequent displacement when subjected to load.

Another issue in this field is the requirement for many different clamping assemblies and knives for the many different types of wood working applications. For example, many wood working applications have different dimensional requirements relating to the knife and the clamping assembly. Thus, different applications may impose different requirements for the shape of the adjacent clamping components. For example, some applications may require that a substantial distance be present between the cutting edge and the lower clamping component (that which is in contact with the underside of the knife). This may be necessary to avoid undesired damage to the cut particles produced or to allow for sufficient space to permit for unobstructed wood movement. Other applications may require the close presence of the lower clamping component to function as a deflecting surface for the proper formation of wafers, veneer, or to intentionally break-up cut particles.

Similarly, strength requirements also differ between applications or according to the type of species being processed, climatic factors, or other external variables. This imposes further restrictions on the size and shape of the knife and the surrounding clamping components since it requires that they be designed to be able to sustain the loads encountered within the relevant geometric constraints.

SUMMARY OF THE INVENTION

Therefore, what is desired is a knife and a cooperating clamping assembly in which the knife can preferably be precisely positioned every time it is installed, even under difficult or awkward conditions. Also, the knife and clamping assembly will each preferably be designed so as to reduce the risk of twisting or displacement during use. Most preferably, the knife and clamping assembly will be more easily adaptable to different loading and dimensional requirements, so that one design can be used in many applications. As well, what is preferred is a knife that can be easily reground to a certain degree for those applications in which limited regrinding may be advantageous.

Therefore, according to one aspect of the invention, there is provided a wood working knife for use in a wood working machine, the knife comprising:

a knife body having a first cutting edge and an opposed second cutting edge, the knife body having a first clamping surface and a second clamping surface;

the first clamping surface having opposed clamping features separated by a middle section, the opposed clamping features and the middle section being sized and shaped such that, upon the knife body being inserted into a clamping assembly, the clamping forces on the first clamping surface are localized towards the opposed cutting edges and away from the middle section.

According to another aspect of the invention, there is provided a knife clamping assembly, for clamping a wood working knife for use in a wood working machine, the knife clamping assembly comprising a first clamping component for clamping a first clamping surface of the knife, and a second clamping component for clamping a second clamping surface of the knife, the first clamping component being sized and shaped to exert a clamping force on opposed clamping features of the knife such that, when the knife is clamped in the clamping assembly, a clamping force on the knife from the first clamping component is localized toward cutting edges of the knife and away from a middle section of the knife.

According to another aspect of the invention, there is provided a locking component for locking a clamping component to a machine, the locking component comprising a locking component body, the locking component body having an externally threaded portion sized and shaped to engage the clamping component, a head having a shoulder sized and shaped to engage the machine, a through hole sized and shaped to permit a threaded fastener to pass therethrough, and driving features for driving the locking component body.

According to another aspect of the invention, there is provided a clamping assembly for clamping a knife in a wood working machine, the clamping assembly comprising:

a first clamping component and a second clamping component, the first and second clamping components being sized and shaped to clamp the knife between the first and second clamping components;

a locking component engageable with the first clamping component to hold said first clamping component onto said machine; and a fastener for attaching at least the second clamping component to the machine;

wherein the locking component is sized, shaped and positioned to permit the fastener to extend through a bore in the locking component when the fastener attaches the second clamping component to the machine.

According to another aspect of the invention, there is provided a method of sharpening a knife having opposed cutting edges, said method comprising the steps of:

(1) holding the knife by clamping features on a first surface of the knife;

(2) simultaneously sharpening opposed edges on said knife; and (3) releasing said knife.

According to another aspect of the invention, there is provided a sharpening fixture for use in sharpening a knife having opposed cutting edges, the fixture comprising a supporting portion sized and shaped to support the knife by registering with a surface of the knife which comprised opposed clamping features and a substantially flat section therebetween.

According to another aspect of the invention, there is provided a wood working knife for use in a wood working machine, the knife comprising:

a knife body having at least one cutting edge and an opposite side, the knife body having a first clamping surface and a second clamping surface;

the first clamping surface having opposed clamping features separated by a middle section, the opposed clamping features and the middle section being sized and shaped such that, upon the knife body being inserted into a clamping assembly, the clamping forces on the first clamping surface are localized towards the cutting edge and the opposite side, and away from the middle section.

BRIEF DESCRIPTION OF THE DRAWINGS

Reference will now be made, by way of example only, to drawings of the invention which illustrate the preferred embodiment of the invention, and in which.

DETAILED DESCRIPTION OF THE PREFERRED EMBODIMENTS

Figure 1:
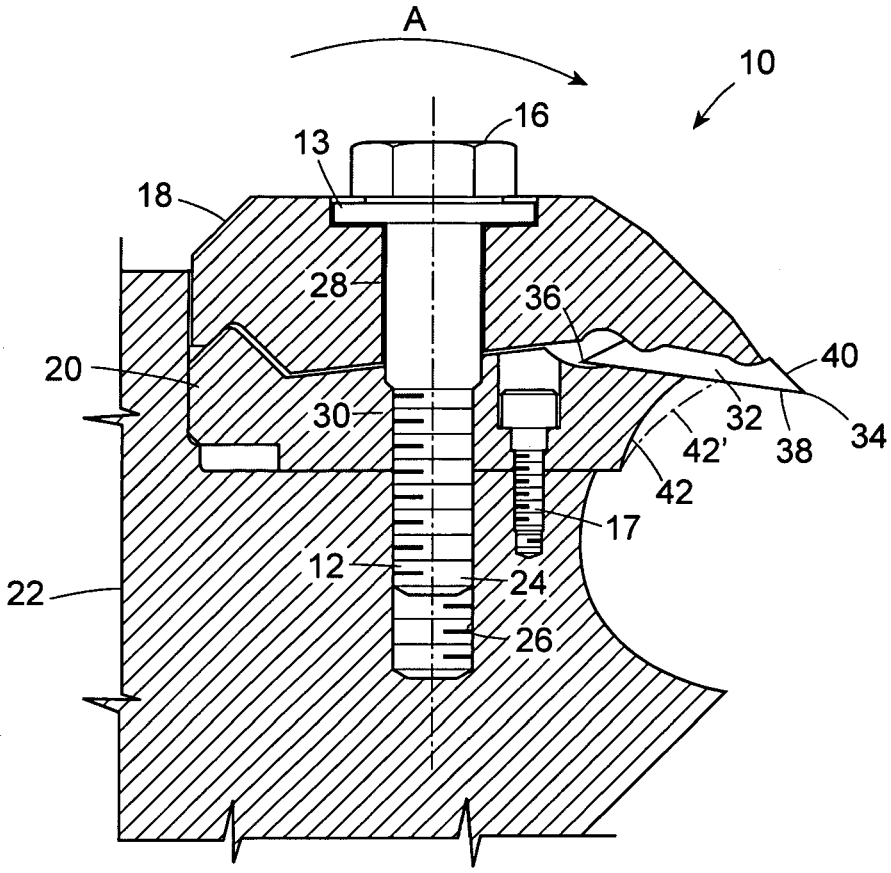
FIG. 1 is a cross sectional view of the knife of the present invention in a knife clamping assembly.

FIG. 1 shows a knife clamping assembly indicated generally by reference numeral 10 clamping a knife 32. The knife clamping assembly 10 is mounted on a base 22 which may be any form of disc, drum, hub, or other base member, as may be used in chippers, chipper-canters, planers, waferizers, or other machines of the type used to process wood to form lumber, chips, veneer or wafers that includes knife clamping assemblies and knives.

The clamping assembly 10 includes a fastener in the form of a bolt 12 having a shaft 14 and a head 16. A washer 13 abuts the head 16. The shaft 14 of the bolt 12 extends through a first clamping component which is preferably in the form of a rear clamping component 18 and a second clamping component which is preferably in the form of a front clamping component 20. The front clamping component 20 is secured to the base using a locking component which is in the form of a base bolt 17.

Although the bolt 12 is shown as the preferred fastener of the clamping assembly 10, the present invention is not limited to using bolts, and comprehends that the clamping assembly 10 may be formed with other types of fastening mechanisms, such as a hydraulic or pneumatic mechanisms and the like. What is important is that the mechanism fastener functions such that, when actuated, it causes the first and second clamping components to clamp a knife therebetween securely enough for wood processing.

In the embodiment shown in FIG. 1, the bolt 12 includes a threaded portion 24 which is threaded into bore 26 in the base 22. By turning the head 16 of the bolt 12, the bolt 12 can be either loosened or tightened as desired. The rear clamping component 18 is provided with a bore 28 therethrough, and the bolt 12 passes through the rear clamping component 18 via the bore 28. Similarly, the front clamping component 20 is provided with a bore 30 and the bolt 12 is inserted through the front clamping component 20 through the bore 30.

In this embodiment, the bolt 12 is positioned so as to be clear of the knife 32. Thus, this embodiment does not require any holes in the knife 32 to accommodate a bolt or other fastener. It will be appreciated by those skilled in the art that making holes in the knife is both expensive and can weaken the knife, meaning that it must be made thicker to achieve the same strength. Thus, the absence of such holes in the preferred embodiment means the knife 32 is smaller and requires less material for its manufacture.

The clamping assembly 10 is shown clamping a knife 32. The knife 32 comprises a knife body having opposed first and second cutting edges 34 and 36. The knife 32 has a first clamping surface which in this embodiment is a rear clamping surface 40. The knife 32 further includes a second clamping surface which in this embodiment is a front clamping surface 38. Each of the clamping surfaces 38, 40 extends between the cutting edges 34, 36. The front clamping component 20 is sized and shaped to clamp against the front clamping surface 38, and the rear clamping component 18 is sized and shaped to clamp the rear clamping surface 40.

In use, the base 22 rotates, thus moving the clamping assembly 10 and the knife 32 in a direction which is indicated by reference character A to drive the exposed cutting edge 34 into wood (not shown). In this specification, "front" means positioned toward the direction of movement of the knife 32 whereas "back" means oriented or positioned away from that direction. Thus, for example, the front clamping surface 38 of the knife 32 is positioned toward the direction of movement of the knife 32, while the rear clamping surface 40 is positioned away from that direction, or downstream. Similarly, the front clamping component 20 is positioned toward the direction of movement of the knife 32, while the rear clamping component 18 is positioned away from that direction.

As the knife 32, and in particular the exposed cutting edge 34, moves, it cuts into the wood being processed (not shown) which is appropriately positioned and/or maneuvered so as to be acted upon by the knife 32 at a depth and orientation that results in the formation of wood chips, shavings, wafers, strands, lumber or veneer. It will be appreciated by those skilled in the art that the drum, disc, hub or base member affixed thereto, which forms the base 22, will typically have a plurality of knives and related clamping assemblies distributed thereon at regular intervals. In this fashion, as rotation of the wood and/or knives occurs, the knives will move and act repeatedly on the wood so as to create the desired wood particles or so as to cut or plane the wood as desired.

In a preferred form of the present invention, the front clamping surface 38 of the knife 32 is substantially flat, and the front clamping component 20 is sized and shaped to clamp against the substantially flat front clamping surface 38. Because the surface 38 is substantially flat, the leading portion 42 of the front clamping component 20 can be placed at a variety of locations along the front clamping surface 38 of the knife 32 without being constrained by protrusions and indentations in the front clamping surface of the knife 32. More specifically, when substantially flat, the front clamping surface 38 does not include any surface features which would limit the range of possible locations of the front clamping component 20 and its leading portion 42 by requiring corresponding features in the clamping component 20. By contrast, having such surface features on the front clamping surface 38 would require that the leading portion 42 be positioned in a way to accommodate such features, in which case the number of possible locations for the leading portion 42 would be reduced. Further, to position the leading portion 42 near a protrusion or indentation, the front clamping component 20 would need to be specially designed to cooperate with the surface feature which is avoided by the instant invention. An altered location for the leading portion 42 is shown as 42' in FIG. 1.

One of the benefits of the present invention can now be appreciated. Depending upon the application, the forward-most location of contact between the knife 32 and the front clamping component 20 on the underside of the knife can be varied depending upon the application to provide support further towards the exposed cutting edge as needed. The leading portion 42 of the front clamping component 20 can be located to clamp more or less of the underside of the knife 32 as needed for any given application, according to space available, stresses arising, wear restrictions and the like. This permits the knife and clamping assembly of the present invention to be used in a variety of applications (planers, disc chippers, etc.) without having to alter the knife profile. In this way one type of knife can be used in many applications.

The substantially flat front clamping surface 38 allows a range of design positions for the leading portion 42. This provides a number of benefits. For example, it provides dimensional flexibility on the front side of the knife 32. Thus, if a particular application requires more room between the exposed cutting edge 34 and the leading portion 42 of the front clamping component 20, this can be easily accomplished through a change in the front clamping component 20. For example, a front clamping component can be conveniently used which has a the leading portion 42 well inward from the edge 34. Similarly, in applications where a close proximity of the leading portion 42 is required for the proper formation of the wood particles, such as may be required with waferizers or planers, this too can be achieved by a front clamping component which extends out towards the edge 34. Although in the preferred embodiment this change is accomplished through a change in the front clamping component 20 as described above, the present invention comprehends the use of an adjuster to alter the position of the leading portion 42.

As well, this configuration allows for the load bearing characteristics of the clamping assembly 10 and knife 32 to be adjusted according to the particular application. For example, a front clamping component 20 with a leading portion 42 closer to the edge 34 (such as at 42') increases the amount of support given to the knife 32 by the clamping assembly 10. This helps secure the knife 32 against incidental loads directed to the top of the blade, for example. The substantially flat front clamping surface 38 therefore allows for more convenient deployment of such a front clamping component 20 such that both dimensional and strength requirements can be met for any given application.

The flat front clamping surface also simplifies the design of the front clamping component 20, since the front clamping component 20 need only have a simple, substantially flat surface to bear on the flat front clamping surface 38. Other, more complex profiles for the front clamping component 20 could also be used with the substantially flat front clamping surface 38 and are comprehended by the present invention, provided adequate support was provided to the knife, but are less preferred for the reasons indicated above.

It can now be appreciated that there is an additional advantage in having a substantially flat front clamping surface 38. That advantage lies in the ability to efficiently regrind the knife 32 if desired, thus sharpening edges 34 and 36 for reuse.

Because the front clamping surface 38 of the knife 32 is preferably substantially flat, it is possible to regrind both of the edges 34, 36 with the removal of material from a single generally planar surface. This provides for an easy and efficient means to regrind the cutting edges of the knife 32 using simple traditional knife grinding equipment of the type generally present within wood processing facilities. Specifically, because the front clamping surface 38 is substantially flat, both the edges 34, 36 can be sharpened simultaneously by applying a single grinder to surface 38. If, by contrast, there were a protrusion in the front clamping surface 38, then the edges 34, 36 could not be sharpened simultaneously using a single grinder, because the protrusion would interfere. Rather, it would be necessary to grind the portion of the front clamping surface adjacent to each of the cutting edges 34, 36 separately, so that regrinding the knife would take twice as long, and it would be more difficult to do evenly.

Similarly, to facilitate regrinding using traditional knife grinding equipment, it is preferable that a substantially flat middle section 52 be provided on the rear clamping surface 40 of the knife 32. It will be appreciated that this shape permits the knife 32 to be held on a flat magnetic table common for such machines by being laid on, and attached by, the substantially flat middle section 52. This permits for convenient regrinding of the knife 32.

Figure 8:
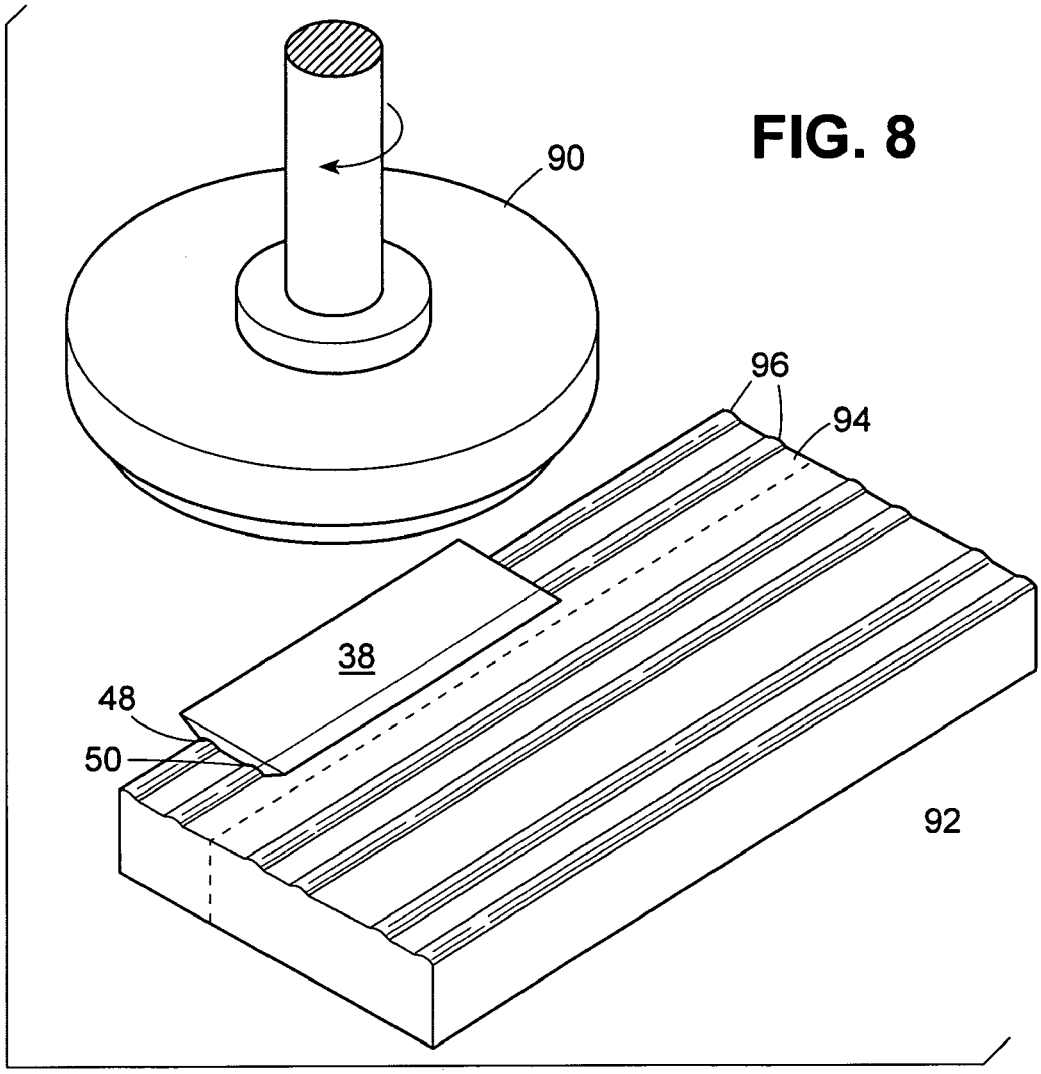
FIG. 8 is an isometric view of a sharpening fixture according to the present invention.

A preferred method of regrinding is illustrated in FIG. 8. FIG. 8 shows a rotary grinder 90, preferably for grinding metal knives 32. One or more knifes 32 are supported on a sharpening fixture 92. The fixture 92 comprises a supporting portion 94 which is preferably sized and shaped to register with the clamping features 48, 50 of the knife 32. Thus, most preferably, the supporting portion has support ridges 96 sized, shaped and positioned to register with the clamping features 48, 50 so as to inhibit lateral movement of the knife 32 during sharpening. The supporting portion 94 may also be sized and shaped to simultaneously register with the substantially flat middle section 52 if desired.

Alternatively, the supporting portion 94 may be sized and shaped to register with the middle section 52 without registering with the clamping features 48, 50. this could be done if the middle section 52 protrudes further than any other part of the rear clamping surface. However, this alternative is not preferred, as it does not inhibit lateral movement during sharpening as effectively as the preferred embodiment. What is important is that the knife 32 be held so as to allow the edges 34, 36 to be simultaneously reground with one pass of a grinding wheel.

It can now be appreciated how the knife is resharpened. First, the knife is held by placing it on the supporting portion 94, preferably so that the ridges 96 register with the clamping features 48, 50. The fixture 92 is magnetized to act as a holder to hold the knife 32 in place. Then, the cutting edges 34, 36 are simultaneously sharpened using the grinder 90, and the knife 32 is released from the table.

Preferably, the edges 34, 36 are reground simultaneously by removing material from the front clamping surface 38, which is substantially flat. During the grinding of the front clamping surface 38, material is removed from the surface 38. This grinding of the surface 38 sharpens the edges 34, 36 by shifting the surface 38 rearward until the edges 34, 36 are sharp once again. It will be appreciated that grinding the substantially flat front clamping surface 38 is preferred because it permits the edges 34, 36 to be simultaneously sharpened while maintaining the precise cutting angles of the edges (i.e. the angles at the intersection of the front clamping surface 38 and the rear clamping surface 40). This is because, by grinding the substantially flat front clamping surface 38 so as to shift the surface rearward, the cutting angles are retained even as the edges are sharpened. Of course, if too much material is removed from surface 38, the position of the edges 34, 36 will be changed enough to affect the performance of the knife. However, some grinding is possible within the manufacturing tolerances of the machine.

Figure 3:
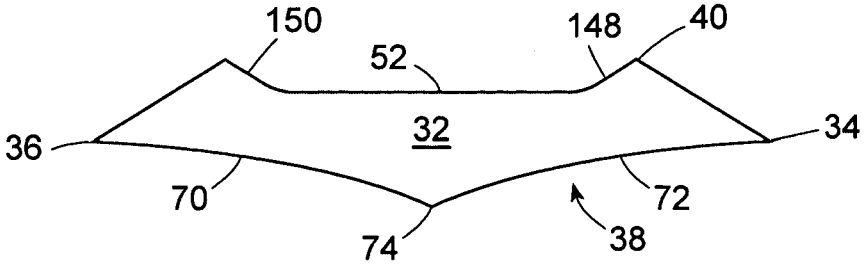
FIG. 3 is a cross sectional view of an alternative knife of the present invention.

It will be appreciated that, though the front clamping surface 38 is preferably substantially flat, the invention comprehends other shapes as well. Such an alternative is shown at FIG. 3. In FIG. 3, the front clamping surface 38 comprises two gently concave surfaces 70, 72 meeting at a central line 74. When the exposed edge 34 is in use, the front clamping component 20 clamps against the surface 70, which is sized and shaped to engage the surface 70. It will be appreciated that this alternative shape for the front clamping component 20 and the front clamping surface 38 provides additional resistance to loads applied to the knife 32 in an direction along the plane of the knife 32. This improves the resistance of the knife to being displaced when mounted in the clamping assembly, whether inwardly in its mounting, by twisting or otherwise.

Figure 2:
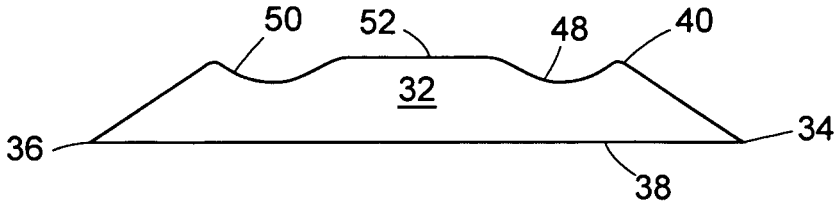
FIG. 2 is a cross sectional view of the knife of the present invention.

Returning to the preferred embodiment as shown in FIG. 2, the rear clamping surface 40 of the knife 32 has opposed clamping features 48, 50, separated by the middle section 52. The clamping features 48, 50 are sized and shaped such that, upon the knife 32 being inserted into the clamping assembly 10, clamping forces on the knife 32 from the rear clamping component 18 are localized towards the cutting edges 34, 36, and away from the middle section 52. The rear clamping component 18 is sized and shaped to register with, and exert a clamping force on, the opposed clamping features 48, 50.

As can now be appreciated by those skilled in the art, the localization of clamping forces toward the edges 34, 36 helps to securely clamp the knife 32. First, localizing the clamping forces towards the cutting edges allows the knife 32 and the clamping assembly 10 to more effectively resist twisting. As previously explained, twisting can occur when uneven cutting forces are applied along the length of the knife 32. Such an imbalance of forces creates a torque on the knife. In such a situation, a portion of the knife 32 can be urged out of the clamping assembly outwardly (i.e. in the direction of rotation A of the base 22) while the opposite portion is urged into the clamping assembly inwardly (i.e. in the direction opposite to rotation A).

It will be appreciated that clamping forces which are localized toward the edges 34, 36 and away from the middle section 52 are better able, because of their spaced apart positioning, to resist a twisting torque on the knife 32. This is because, for any given clamping force, the capabilities to resist twisting are proportional to the distance between the clamping forces. Consequently, clamping forces, which are localized towards the extreme outer cutting edges, will most effectively counteract the twisting torque on the knife 32. It will be appreciated that, the further away the clamping force is localized from the middle of the knife 32, the more effectively twisting can be resisted. Thus, preferably, the majority of the clamping force will be localized toward the edges 34, 36 and away from the middle section 52. More preferably, at least 80 percent of the clamping force will be localized toward the edges 34, 36 and away from the middle section 52. Most preferably, all of the clamping force will be localized toward the edges 34, 36 and away from the middle section 52.

It will also be appreciated that localizing clamping forces toward the edges 34, 36 increases the ability of the knife 32 to bear the type of loads that result from the transformation of the wood into chips, wafers, shavings, veneer, or other such wood particles. This is because the portion of the clamping force localized toward the exposed cutting edge 34 is located nearer to the part of the knife 32 that is acted upon by the wood. Thus, the knife 32 is supported better against such loads when the clamping force is localized toward the edges 34, 36 and away from the middle section 52.

In the preferred embodiment, the clamping features 48, 50 are concave hollows, or indentations, in the rear clamping surface 40. It will be appreciated that the use of concave hollows has the advantage that the shape of the hollows results in the clamping force being applied in a direction that is substantially downward against the knife (i.e. orthogonal to the plane formed by edges 34, 36). Such an arrangement helps ensure that when the rear clamping component 18 registers with, and exerts a clamping force on, opposed clamping features 48, 50, there is no tendency for the clamping features to be wedged apart. Thus, relative to some other possible clamping feature configurations, bending stresses in the knife 32 are minimized. Further, the use of concave hollows provides significant additional load carrying abilities in the form of resistance to twisting and the of displacement inward.

Figure 4:
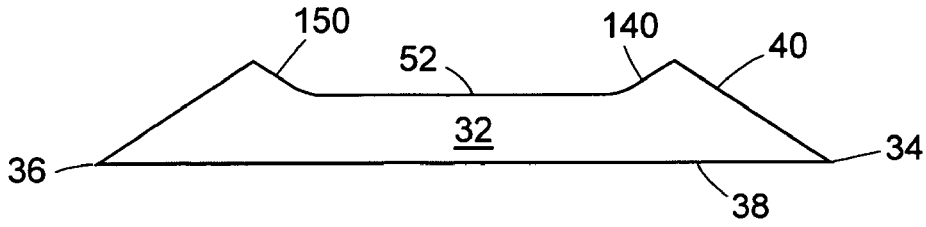
FIG. 4 is a cross sectional view of a second alternative knife of the present invention.

It will be appreciated however, that the clamping features need not be the concave hollows of the preferred embodiment. For example, in the alternative embodiments shown in FIGS. 3–5, the clamping features take the form of opposing inclined surface sections 148, 150, which are oriented diagonally relative to the edges 34, 36. The clamping features may also be structured such that each clamping feature comprises two opposed surface sections inclined with respect to one another and moving further apart as they extend rearwardly. What is important is that the clamping features are sized and shaped to localize the clamping force toward the edges 34, 36 and away from the middle section 52.

Figure 5:
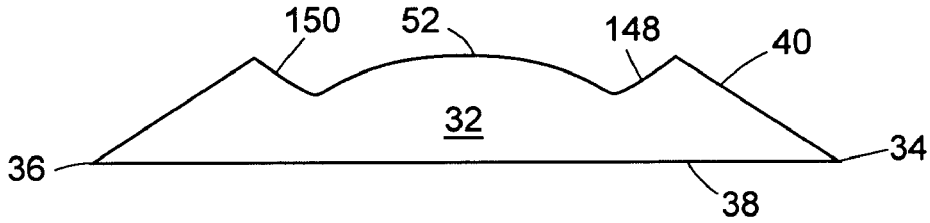
FIG. 5 is a cross sectional view of a third alternative knife of the present invention.

As previously explained, it is preferable that the middle section 52 be substantially flat in shape to permit for convenient regrinding of the knife 32. It will also be appreciated, however, that the middle section 52 need not have this preferred shape. An alternative shape for the middle surface 52 is shown at FIG. 5 in which the profile gradually increases in thickness in the center section. This can be beneficial, for example, when resisting high cutting forces that otherwise result in a tendency to bend the knife under load.

As can now be appreciated, a further feature of this invention is that the opposed clamping features 48, 50 are also sized and shaped to act as locating features which direct the knife 32 to a predetermined position relative to the rear clamping component 18 when the knife is fastened in the clamping assembly 10. For example, when the clamping features 48, 50 have the preferred concave hollow shape, should the knife position be slightly displaced or askew as it is clamped, the rear clamping surface 18 will engage and exert a locating force on the sides of the concave hollows and push the knife 32 to the proper and preferred seating position. Once the knife 32 is in the correct position, the lateral or sideways forces against the clamping features balance substantially to zero, and the knife is positioned. Similarly, the knife 32 will also be directed to the predetermined position by engaging the clamping features 148, 150 having the alternative diagonal shape described above and shown in FIGS. 3–5. Essentially, what is required, is to have two opposed inclined edges (whether curved or straight) which cause the knife to self center, or self locate, preferably relative to the rear clamping component 18, as the clamping assembly 10 is clamped onto the knife 32.

It will be appreciated that such locating features, cooperating with the rear clamping component 18, permit the automatic positioning of the knife 32 as the clamping assembly 10 is tightened on the knife 32. Thus, the exposed cutting edge 34 can be quickly and precisely positioned relative to the clamping assembly 10 without requiring exacting or time-consuming work by the person installing the knife 32. Further, accuracy of position can be maintained when the knife is subjected to load. In this regard, it is necessary for the rear clamping component 18 to have the appropriate features to register with the clamping features of the knife and bear the majority of the clamping and cutting forces.

It will be appreciated that, although the clamping features act as locating features in the preferred embodiment, the invention also comprehends locating features that are separate from the clamping features. What is important is that the locating features are sized and shaped to direct the knife 32 to a predetermined position when the knife 32 is fastened in the clamping assembly 10.

In the preferred embodiment shown in FIG. 1, the front clamping component 20 is fixedly attachable to the base 22 by the base bolt 17. Likewise, the rear clamping component 18 is attachable to the base 22 via the bolt 12 so as to be movable between an open position and a clamped position. Thus, when a knife is to be removed from the clamping assembly 10, the rear clamping component 18 is moved to an open position by loosening the bolt 12. To secure a knife 32 in the clamping assembly 10, the knife 32 is placed between the clamping components 18, 20 and the rear clamping component 18 is moved to a clamped position by tightening the bolt 12.

Figure 6B:
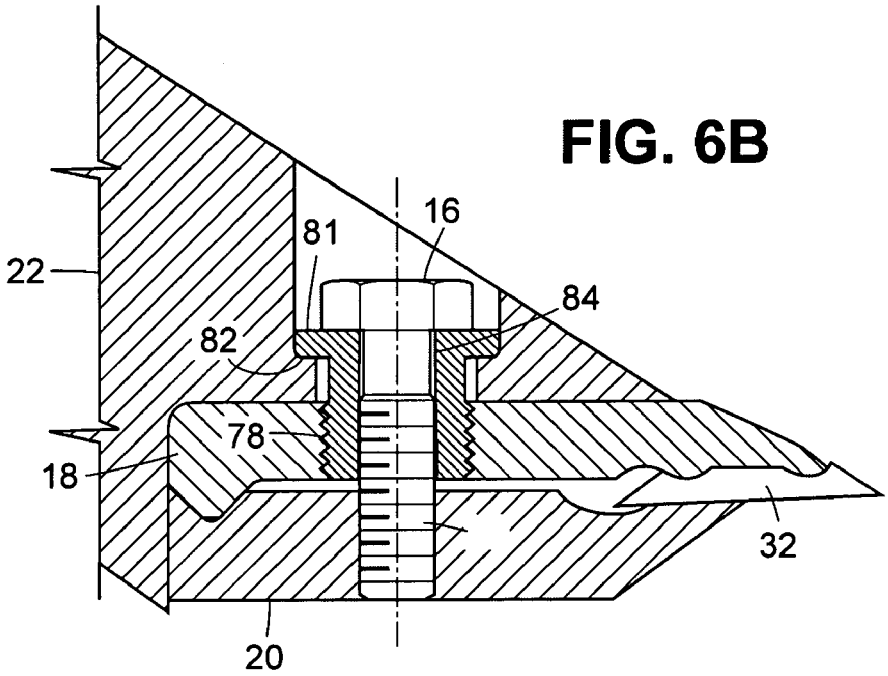
FIG. 6A is an exploded isometric view and FIG. 6B is a cross-sectional view of a knife in an alternative clamping assembly according to the present invention, along with a driving tool for assembling the driving assembly.
Figure 6A:
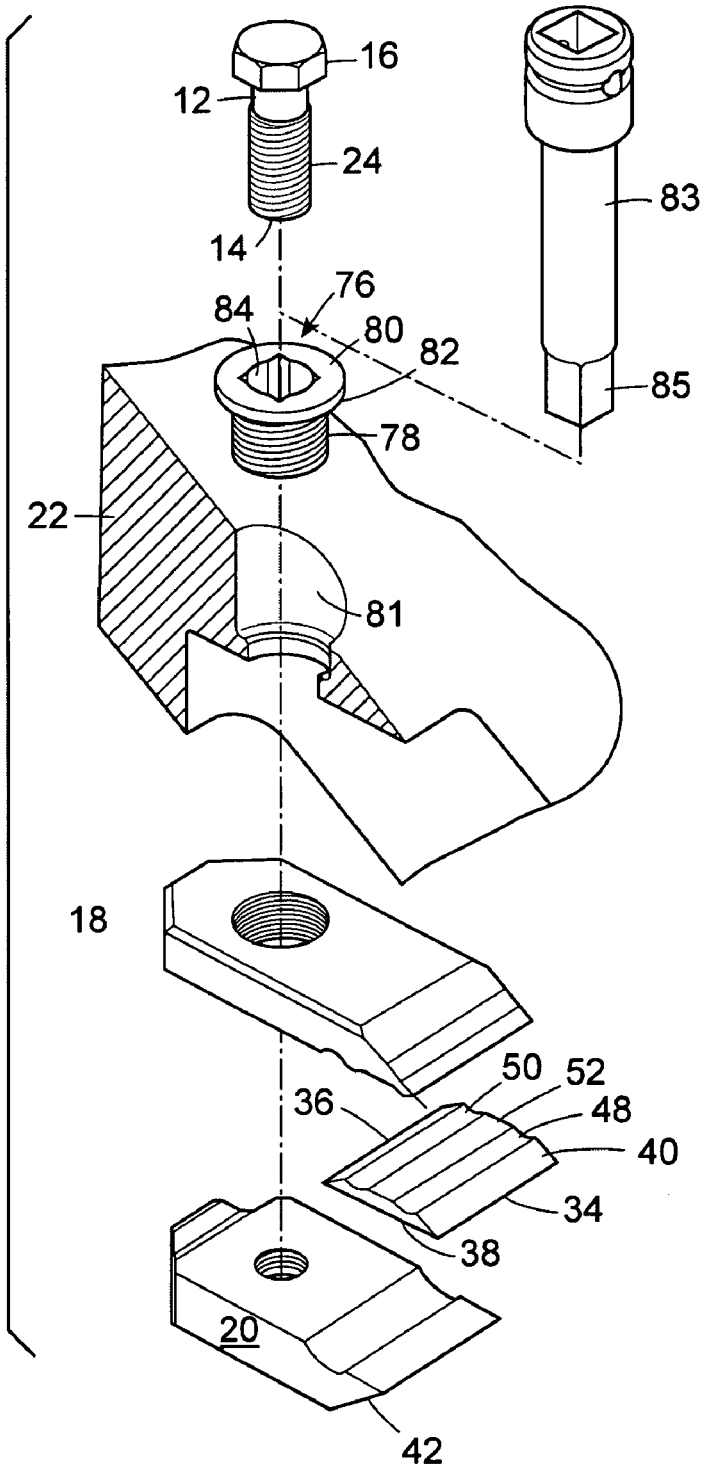

FIGS. 6A and 6B show an alternative clamping arrangement. In this arrangement, it is the rear clamping component 18 that is fixedly attachable to the base 22. The front clamping component 20 is movable between an open position and a clamped position. This arrangement is often referred to as "underside clamping", because the moving portion of the clamping assembly 10 is on the front or "underside" of the knife 32.

It will be appreciated that underside clamping has the advantage of allowing the clamping assembly and the base 22 to more effectively support cutting loads generated by the impact between the knife 32 and wood. In underside clamping, the rear clamping component 18 bears against the base 22 which is typically a rigid foundation component. By contrast, in FIG. 1, the front clamping component is held in place by the bolt 12. With this arrangement the stiffness of the bolt has a significant influence on the overall load carrying capability of the knife assembly.

It will also be appreciated by those skilled in the art that underside clamping can often be done in less space than the clamping arrangement in FIG. 1. Thus, underside clamping can be useful in situations where the knife 32 and the clamping assembly are located within a confined area.

In the preferred clamping assembly shown in FIG. 6, the assembly includes a locking component in the form of a locking screw 76 which engages with the rear clamping component 18. The locking screw 76 has an externally threaded portion 78 sized and shaped to secure the rear clamping component 18 to the base 22. The locking screw 76 also has a screw head 80 having a shoulder 82 sized and shaped to abut the bottom of a counterbore 81 in the base 22, and an internal through bore 84 sized and shaped to accommodate the bolt 12, as well as driving features for driving the screw 76.

Figure 7:
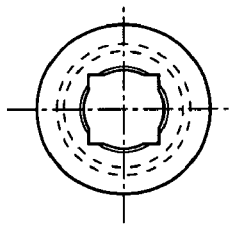
FIG. 7 is a plan view of a locking component according to the present invention.

Preferably, the driving features comprise a set of square corners 86 that run through the length of bore 84 of the screw 76 that are sized and shaped to be engaged by a driving tool 83 having a square drivable driving head 85. The driving features 86 are visible in FIG. 7. It will be appreciated that the invention comprehends driving features and driving tools other than the preferred configurations described above. What is important is that the driving features permit the screw 76 to the driven so as to secure the rear clamping component 18 against the base 22.

It can now be appreciated how the locking screw 76 is used. The rear clamping component 18 is engaged with the locking screw 76, installed into the counterbore 81 of base 22. The locking screw 76 is then tightened using the driving tool 83 in engagement with the driving features so as to secure the rear clamping component 18 against the base 22. The rear clamping component 18 is held in place by the shoulder 82 and the externally threaded portion 78

The bolt 12 is then inserted through the screw 76, and it engages the threaded bore in the front clamping component 20. The front clamping component 20 is moved from an open position to a clamped position by turning the bolt 12. Thus, it will be apparent that in this configuration, the bolt 12 is concentric with the screw 76.

It will be appreciated by those skilled in the art that this configuration using the screw 76 has certain advantages. First, as compared with simply using the bolt 12 both the fix the rear clamping component 18 and hold the front clamping component, the configuration using a locking screw 76 causes the rear clamping component 18 to be more stiffly and rigidly fixed to the base 22. This is because the screw 76 is devoted exclusively to affixing the rear clamping component 18. Furthermore, when a knife 32 is clamped, both the bolt 12 and the screw 76 are available to resist forces generated during cutting, giving the assembly greater stiffness and strength. Thus, the benefits of a more rigidly positioned rear clamping component 18, discussed above, are provided in this configuration.

Second, the screw 76 protects the base 22 from contact with the head 16 of the bolt 12. Specifically, because the bolt 12 is activated often by being opened and closed, galling can occur on the base 22 if the head 16 of bolt 12 and the base 22 are in contact. However, in this configuration, the head 16 only contacts the screw 76 and shoulder 82 which prevents galling of the base 22. It will be appreciated that it is less expensive to replace the screw 76 when it is worn than it is to replace the section of the base 22 that becomes worn down by the bolt head 76.

Finally, the locking screw also affords the advantage that the rear clamping component 18 can easily be secured to the base 22 from the rear or "topside". Often, in wood working machines space is limited such that it is not possible or desirable to use fasteners installed from the underside due to the lack of access to the base 22 from the front side of the machine.

While the foregoing embodiments of the present invention have been set forth in considerable detail for the purposes of making complete disclosure of the invention, it will be apparent to those skilled in the art that various modifications can be made to the knife and clamping assembly without departing from the scope of the invention as defined in the attached claims. Some of these variations are discussed above and others will be apparent to those skilled in the art. For example, a non-reversible, single edged blade could be used for the knife 32 wherein the knife has only one cutting edge on one side of the knife but no edge on the opposite side.

The invention claimed is:

1. A knife and clamping assembly comprising a wood working knife for use in a wood working machine, said knife having:

a knife body including a first cutting edge, an opposed second cutting edge, a first clamping surface and a second opposed clamping surface;

said first clamping surface having opposed clamping features separated by a middle section;

and a clamping assembly including first and second clamping components for respectively engaging said first and second clamping surfaces;

said opposed clamping features and the middle section of said knife being sized and shaped such that, upon the knife body being inserted into said clamping assembly between said clamping components, the clamping forces on the first clamping surface are localized towards the opposed cutting edges and away from the middle section; said clamping features comprising concave hollows in said first clamping surface.

2. The knife and clamping assembly of claim 1, wherein the first clamping surface further comprises locating features sized and shaped to direct the knife to a predetermined position when the knife is fastened in the clamping assembly.

3. The knife and clamping assembly of claim 1, wherein said clamping features are sized and shaped to direct the knife to a predetermined position when the knife is fastened in the clamping assembly.

4. A knife and clamping assembly comprising a wood working knife for use in a wood working machine, said knife having:

a knife body including a first cutting edge, an opposed second cutting edge, a first clamping surface and a second opposed clamping surface;

said first clamping surface having opposed clamping features separated by a middle section;

and a clamping assembly including first and second clamping components for respectively engaging said first and second clamping surfaces;

said clamping features comprising opposing surface portions inclined with respect to each other, and said middle section having a central smooth surface area extending between the clamping features whereby upon insertion of the knife body into the clamping assembly the localization of the clamping forces on the first clamping surface occurs only at said two opposed clamping features and said clamping forces are localized and located away from said middle section.

5. The knife and clamping assembly of claim 1 or claim 4, wherein the first clamping surface comprises a rear clamping surface of the knife body and wherein the second clamping surface comprises a front clamping surface of the knife body.

6. The knife and clamping assembly of claim 5, wherein the front clamping surface is substantially flat in shape.

7. The knife and clamping assembly of claims 1 or 4, wherein the middle section is substantially flat in shape.

8. The knife and clamping assembly of claim 1 or claim 4, wherein the knife body is free of clamping through-holes.

9. The knife and clamping assembly of claim 1 or claim 4, wherein the opposed clamping features and the middle section are sized and shaped such that, when the knife is inserted into the clamping assembly, the majority of a clamping force exerted by the first clamping component is localized on the clamping features.

10. The knife and clamping assembly of claim 1 or claim 4, wherein the opposed clamping features and the middle section are sized and shaped such that, when the knife is inserted into the clamping assembly, at least 80 percent of a clamping force exerted by the first clamping component is localized on the clamping features.

11. The knife and clamping assembly of claim 1 or claim 4, wherein the opposed clamping features and the middle section are sized and shaped such that, when the knife is inserted into the clamping assembly, substantially all of a clamping force exerted by the first clamping component is localized on the clamping features.

12. A knife and clamping assembly for use in a wood working machine, comprising a wood working knife having first and second clamping surfaces, a pair of cutting edges and a pair of opposed clamping features between said cutting edges, and a clamping assembly including a first clamping component for clamping the first clamping surface of the knife, and a second clamping component for clamping the second clamping surface of the knife, the first clamping component being sized and shaped to exert a clamping force on the opposed clamping features of the knife such that, when the knife is clamped in the clamping assembly, a clamping force on the knife from the first clamping component is localized toward the cutting edges of the knife and away from a middle section of the knife, said first clamping component being sized and shaped to register with the opposed clamping features of the knife and said clamping features comprising concave hollows in the knife.

13. The knife and clamping assembly of claim 12, wherein the first clamping component is sized and shaped to exert a locating force on said clamping features of the knife such that the knife is directed to a predetermined position when the knife is clamped in the clamping assembly.

14. The knife and clamping assembly of claim 12, wherein the first clamping component further comprises locating features sized and shaped to exert a locating force on the knife such that the knife is directed to a predetermined position when the knife is clamped in the clamping assembly.

15. A knife and clamping assembly for use in a wood working machine, comprising a wood working knife having first and second clamping surfaces, a pair of spaced cutting edges, and a pair of opposed clamping features, and a clamping assembly including a first clamping component for clamping the first clamping surface of the knife, and a second clamping component for clamping the second clamping surface of the knife, the first clamping component being sized and shaped to exert a clamping force on the opposed clamping features of the knife such that, when the knife is clamped in the clamping assembly, a clamping force on the knife from the first clamping component is localized toward the cutting edges of the knife and away from a middle section of the knife, said first clamping component being sized and shaped to register with the opposed clamping features of the knife and said clamping features comprising opposing surface sections inclined with respect to each other; and said knife body having a central smooth surface area extending between the clamping features.

16. The knife and clamping assembly of claims 12 or 15, wherein the first clamping component is fixedly attachable to a movable base of the wood working machine, and wherein the second clamping component is attachable to the base so as to be movable between an open position and a clamping position.

17. A knife and clamping assembly for use in a wood working machine, comprising a wood working knife having first and second clamping surfaces, a pair of spaced cutting edges and a pair of opposed clamping features, and a clamping assembly including a first clamping component for clamping the first clamping surface of the knife, and a second clamping component for clamping the second clamping surface of the knife, the first clamping component being sized and shaped to exert a clamping force on the opposed clamping features of the knife such that, when the knife is clamped in the clamping assembly, a clamping force on the knife from the first clamping component is localized toward the cutting edges of the knife and away from a middle section of the knife, wherein said second clamping component is adapted to be fixedly attachable to a movable base of the wood working machine, and wherein the first clamping component is attachable to the base so as to be movable between an open position and a clamping position.

18. The knife and clamping assembly of claims 12, 15 or 17, wherein the second clamping component is sized and shaped to clamp against the second clamping surface, wherein the second clamping surface is substantially flat in shape.

19. The knife and clamping assembly of claim 11, further comprising a fastener connectable to the first and second clamping components and sized, shaped and positioned to be non-intersecting with the knife when the knife is inserted in the clamping assembly.

20. The knife and clamping assembly of claims 12, 15 or 17, wherein the first clamping component is sized and shaped such that the majority of a clamping force on the knife from the first clamping component is localized toward cutting edges of the knife and away from the middle section of the knife.

21. The knife and clamping assembly of claims 12, 15 or 17, wherein the first clamping component is sized and shaped such that at least 80 percent of a clamping force on the knife from the first clamping component is localized toward the cutting edges of the knife and away from the middle section of the knife.

22. The knife and clamping assembly of claims 12, 15 or 17, wherein the first clamping component is sized and shaped such that substantially all of a clamping force on the knife from the first clamping component is localized toward the cutting edges of the knife and away from the middle section of the knife.

23. The knife and clamping assembly of claim 16, wherein the first clamping component comprises a rear clamping component, and wherein the second clamping component comprises a front clamping component.

24. A wood working knife for use in a clamping assembly in a wood working machine in which the clamping assembly will apply locating and clamping forces to the knife in predetermined locations, said knife comprising:

a knife body having at least one cutting edge, an opposite side to said edge and opposed first and second clamping surfaces;

the first clamping surface having opposed clamping features respectively including surface portions which are inclined with respect to each other and separated by a smooth uninterrupted middle section, said opposed clamping features and the middle section being sized and shaped such that when the knife body is inserted into a clamping assembly, the locating and clamping forces applied to said clamping features on the first clamping surface position the knife in the clamping assembly so the locating forces balance substantially to zero and the clamping forces are localized towards the cutting edge and the opposite side, and away from the middle section.

25. The knife of claim 24, wherein the clamping features on said clamping surface further comprise locating features and are sized and shaped to direct the knife to a predetermined position when the knife is fastened in the clamping assembly whereby the clamp features also serve as locating features.

26. The knife and clamping assembly of claim 1, wherein said middle section of said knife is a central smooth surface area extending between the clamping features whereby the localization of the clamping forces occurs only at said two opposed clamping features.

27. The knife and clamping assembly of claim 26, wherein said central smooth surface area of the knife is substantially flat.

28. The knife of claim 24, wherein the clamping features are concave hollows in the first clamping surface.

29. A wood working knife comprising:

a knife body having a first cutting edge and an opposed second cutting edge, the knife body having a first clamping surface and an opposed second clamping surface;

said first clamping surface having opposed clamping features respectively including surface portions which are inclined with respect to each other and separated by a smooth uninterrupted middle section, the opposed clamping features and the middle section of the first clamping surface being sized and shaped such that when a clamping force is applied to said clamping features, the clamping forces are localized towards the opposed cutting edges and away from the middle section.

30. The knife of claim 29, wherein the clamping features are concave hollows in the first clamping surface.

31. The knife of claim 29 or 30, wherein the first clamping surface comprises a rear clamping surface of the knife body and wherein the second clamping surface comprises a front clamping surface of the knife body.

32. The knife of claim 31, wherein the front clamping surface is substantially flat in shape.

33. The knife of claim 29 or 30, wherein the middle section is substantially flat in shape.

34. The knife of claim 29 or 30, wherein the opposed clamping features and the middle section are sized and shaped such that a majority of a clamping force exerted on the knife is localized on the clamping features.

35. The knife of claim 29 or 30, wherein the opposed clamping features and the middle section are sized and shaped such that at least 80 percent of a clamping force exerted on the knife is localized on the clamping features.

36. The knife of claim 29 or 30, wherein the opposed clamping features and the middle section are sized and shaped such that substantially all of a clamping force exerted on the knife is localized on the clamping features.

37. A wood working knife for use in a wood working machine comprising:

a knife body having at least one cutting edge, an opposite side to said cutting edge, and opposed first and second clamping surfaces;

the first clamping surface having opposed clamping features separated by a central smooth uninterrupted non load bearing middle section and said clamping features having surface portions which face each other, and are concave hollows in the first clamping surfaces.

38. A wood working knife for use in a wood working machine comprising:

a knife body having at least one cutting edge, an opposite side to said cutting edge, and opposed first and second clamping surfaces;

the first clamping surface having opposed spaced clamping features separated by a central non load bearing middle section and said clamping features having surface portions which face each other, and are concave hollows in the first clamping surface, whereby when said knife is placed in a knife clamping assembly substantially all of the clamping force applied to said first clamping surface is applied to said clamping features.

39. A wood working knife for use in a wood working machine comprising:

a knife body having at least one cutting edge, an opposite side to said cutting edge, and opposed first and second clamping surfaces;

the first clamping surface having opposed spaced clamping features separated by a central smooth uninterrupted middle section; said spaced clamping features having surface portions which face each other, and are concave hollows in the first clamping surface, whereby when said knife is placed in a knife clamping assembly at least 80 percent of the clamping force applied to said first clamping surface is applied to said clamping features.

40. A clamping assembly for clamping a knife in a wood working machine, said clamping assembly comprising:

first and second clamping members having opposed clamping surfaces;

one of said clamping members' clamping surfaces having first and second spaced clamping features and a middle section therebetween;

said clamping features and said middle section being sized and shaped such that said clamping features will exert clamping forces on a knife placed between the clamping members, with said clamping forces being exerted only on the clamping features components, and said clamping features being convex projections on said one of said clamping surfaces.

41. A clamping assembly for clamping a knife in a wood working machine, said clamping assembly comprising:

first and second clamping members having opposed clamping surfaces;

one of said clamping members' clamping surface having first and second spaced clamping features and a middle section therebetween;

said clamping features and said middle section being sized and shaped such that at least 80 percent of the clamping force exerted by said at least one clamping member on a knife placed between and in contact with the clamping members, is applied to the knife only at the first and second clamping features and said clamping features being convex projections on said one of said clamping surfaces.

42. A clamping assembly for clamping a knife in a wood working machine, said clamping assembly comprising:

first and second clamping members having opposed clamping surfaces;

one of said clamping members' clamping surfaces having first and second spaced clamping features and a middle section therebetween;

said clamping features and said middle section being sized and shaped such that a majority of the clamping force exerted by said at least one clamping member on a knife placed between and in contact with the clamping members is applied to the knife only at the first and second clamping features and said clamping components being convex projections on said one of said clamping surfaces.

43. A clamping assembly for clamping a knife in a wood working machine, said clamping assembly comprising:

first and second clamping members having opposed clamping surfaces;

one of said clamping members' clamping surfaces having first and second spaced clamping features and a middle section there between;

said clamping features and said middle section being sized and shaped such that said at least one clamping member will exert clamping forces on a knife placed between and in contact with the clamping members only at the first and second clamping features and said middle section being a smooth surface area extending between the clamping components.

44. A clamping assembly for clamping a knife in a wood working machine, said clamping assembly comprising:

first and second clamping members having opposed clamping surfaces;

one of said clamping members' clamping surface having first and second spaced clamping features and a middle section therebetween;

said clamping features and said middle section being sized and shaped such that at least 80 percent of the clamping forces exerted by said one clamping member on a knife placed between and in contact with the clamping members, is applied at the first and second clamping features and said middle section being a smooth surface area extending between the clamping components.

45. A clamping assembly for clamping a knife in a wood working machine, said clamping assembly comprising:

first and second clamping members having opposed clamping surfaces;

one of said clamping members' clamping surfaces having first and second spaced clamping features and a middle section therebetween;

said clamping features and said middle section being sized and shaped such that a majority of the clamping force exerted by said one clamping member on a knife placed between and in contact with the clamping members is applied at the first and second clamping features and said middle section being a smooth surface area extending between the clamping components.

46. The clamping assembly of claims 40, 41, 42, 43, 44 or 45, wherein said middle section is flat.

47. A knife and clamping assembly comprising a wood working knife for use in a wood working machine, said knife having:

a knife body including a first cutting edge, an opposed second cutting edge, a first clamping surface and a second opposed clamping surface;

said first clamping surface having opposed clamping features separated by a middle section;

and a clamping assembly including first and second clamping components for respectively engaging said first and second clamping surfaces;

said clamping features comprising opposing inclined surfaces, and said middle section having a central smooth surface area extending between the clamping features whereby upon insertion of the knife body into the clamping assembly the localization of the clamping forces occurs only at said two opposed clamping features and away from said middle section;

said first clamping surface comprising a rear clamping surface of the knife body and said second clamping surface comprising a front clamping surface of the knife body; and said front clamping surface being substantially flat in shape.

48. A knife and clamping assembly comprising a wood working knife for use in a wood working machine, said knife having:

a knife body including a first cutting edge, an opposed second cutting edge, a first clamping surface and a second opposed clamping surface;

said first clamping surface having opposed clamping features separated by a middle section;

and a clamping assembly including first and second clamping components for respectively engaging said first and second clamping surfaces;

said clamping features comprising opposing inclined surfaces, and said middle section having a central smooth surface area extending between the clamping features whereby upon insertion of the knife body into the clamping assembly the localization of the clamping forces occurs only at said two opposed clamping features and away from said middle section; and said middle section of the first clamping surface being substantially flat in shape.

49. A knife and clamping assembly for use in a wood working machine, comprising a wood working knife having first and second clamping surfaces, a pair of cutting edges and a pair of opposed clamping features, and a clamping assembly including a first clamping component for clamping the first clamping surface of the knife, and a second clamping component for clamping the second clamping surface of the knife, the first clamping component being sized and shaped to exert a clamping force on the opposed clamping features of the knife such that, when the knife is clamped in the clamping assembly, a clamping force on the knife from the first clamping component is localized toward the cutting edges of the knife and away from a middle section of the knife, said first clamping component being sized and shaped to register with the opposed clamping features of the knife and said clamping features comprising opposing inclined surface sections; and said knife body having a central smooth surface area extending between the clamping features; and said first clamping component being fixedly attachable to a movable base of the wood working machine, and wherein the second clamping component is attachable to the base so as to be movable between an open position and a clamping position.

50. A knife and clamping assembly for use in a wood working machine, comprising a wood working knife having first and second clamping surfaces, a pair of cutting edges and a pair of opposed clamping features, and a clamping assembly including a first clamping component for clamping the first clamping surface of the knife, and a second clamping component for clamping the second clamping surface of the knife, the first clamping component being sized and shaped to exert a clamping force on the opposed clamping features of the knife such that, when the knife is clamped in the clamping assembly, a clamping force on the knife from the first clamping component is localized toward the cutting edges of the knife and away from a middle section of the knife, said first clamping component being sized and shaped to register with the opposed clamping features of the knife and said clamping features comprising opposing inclined surface sections; and said knife body having a central smooth surface area extending between the clamping features; and wherein the second clamping component is sized and shaped to clamp against the second clamping surface, and wherein the second clamping surface is substantially flat in shape.

51. The knife and clamping assembly of claim 50, wherein the first clamping component comprises a rear clamping component, and wherein the second clamping component comprises a front clamping component.

52. A knife and clamping assembly comprising a wood working knife for use in a wood working machine, said knife having:

a knife body including a first cutting edge, an opposed second cutting edge, a first clamping surface and a second opposed clamping surface;

said first clamping surface having opposed clamping features separated by a middle section;

and a clamping assembly including first and second clamping components for respectively engaging said first and second clamping surfaces;

said clamping features comprising opposing inclined surfaces, and said middle section having a central smooth surface area extending between the clamping features whereby upon insertion of the knife body into the clamping assembly the localization of the clamping forces occurs only at said two opposed clamping features and away from said middle section; and wherein said central smooth surface area of the knife is substantially flat.

53. A wood working knife for use in a clamping assembly in a wood working machine in which the clamping assembly will apply clamping forces to the knife in predetermined locations, said knife comprising:

a knife body having at least one cutting edge, an opposite side to said edge and opposed first and second clamping surfaces;

the first clamping surface having opposed clamping features separated by a smooth uninterrupted middle section, said opposed clamping features and the middle section being sized and shaped such that when the knife body is inserted into a clamping assembly, the clamping forces applied to said clamping features on the first clamping surface are localized towards the cutting edge and the opposite side, and away from the middle section; and wherein the clamping features are concave hollows in the first clamping surface.

54. The knife of claim 53, wherein the clamping features include opposing inclined surface portions.

55. A wood working knife comprising:

a knife body having a first cutting edge and an opposed second cutting edge, the knife body having a first clamping surface and an opposed second clamping surface;

said first clamping surface having opposed clamping features separated by a smooth uninterrupted middle section, the opposed clamping features and the middle section being sized and shaped such that when a clamping force is applied to said clamping features, the clamping forces are localized towards the opposed cutting edges and away from the middle section; and wherein the clamping features are concave hollows in the first clamping surface.

56. The knife of claim 55, wherein the first clamping surface comprises a rear clamping surface of the knife body and wherein the second clamping surface comprises a front clamping surface of the knife body.

57. The knife of claim 56, wherein the front clamping surface is substantially flat in shape.

58. The knife of claim 55, wherein the middle section is substantially flat in shape.

59. The knife of claim 55, wherein the opposed clamping features and the middle section are sized and shaped such that a majority of a clamping force exerted on the knife is localized on the clamping features.

60. The knife of claim 55, wherein the opposed clamping features and the middle section are sized and shaped such that at least 80 percent of a clamping force exerted on the knife is localized on the clamping features.

61. The knife of claim 55, wherein the opposed clamping features and the middle section are sized and shaped such that substantially all of a clamping force exerted on the knife is localized on the clamping features.

62. A wood working knife for use in a wood working machine comprising:

a knife body having at least one cutting edge, an opposite side to said cutting edge, and opposed first and second clamping surfaces;

the first clamping surface having opposed clamping features separated by a central smooth uninterrupted non load bearing middle section; and wherein said clamping features are concave hollows in the first clamping surface.

63. A wood working knife for use in a wood working machine comprising:

a knife body having at least one cutting edge, an opposite side to said cutting edge, and opposed first and second clamping surfaces;

the first clamping surface having opposed spaced clamping features separated by a central non load bearing middle section, whereby when said knife is placed in a knife clamping assembly substantially all of the clamping force applied to said first clamping surface is applied to said clamping features; and said clamping features being concave hollows in the first clamping surface.

64. A knife and clamping assembly comprising a wood working knife for use in a wood working machine, said knife having:

a knife body including a first cutting edge, an opposed second edge, a first clamping surface and a second opposed clamping surface;

said first clamping surface having opposed spaced clamping features separated by a middle section;

and a clamping assembly including first and second clamping components for respectively engaging said first and second clamping surfaces;

said clamping features, said clamping components and said middle section of the knife being configured such that the clamping forces exerted by the clamping component engaged with the first clamping surface of the knife occur only at said two opposed clamping features; and said clamping features being concave hollows in the first clamping surface.

65. A knife and clamping assembly comprising a wood working knife for use in a wood working machine, said knife having:

a knife body including a first cutting edge, an opposed second edge, a first clamping surface and a second opposed clamping surface;

said first clamping surface having opposed spaced clamping features separated by a middle section;

and a clamping assembly including first and second clamping components for respectively engaging said first and second clamping surfaces;

said clamping features, said clamping components and said middle section of the knife being configured such that at least 80 percent of the clamping force exerted by the clamping component engaged with the first clamping surface of the knife occurs at said two opposed clamping features; and said clamping features being concave hollows in the first clamping surface.

66. A knife and clamping assembly comprising a wood working knife for use in a wood working machine, said knife having:

a knife body including a first cutting edge, an opposed second edge, a first clamping surface and a second opposed clamping surface;

said first clamping surface having opposed spaced clamping features separated by a middle section;

and a clamping assembly including first and second clamping components for respectively engaging said first and second clamping surfaces;

said clamping features, said clamping components and said middle section of the knife being configured such that the majority of the clamping force exerted by the clamping component engaged with the first clamping surface of the knife occurs at said two opposed clamping features;

said clamping features being concave hollows in the first clamping surface.

67. The knife and clamping assembly of claims 64, 65 or 66 wherein said opposed edged is a cutting edge.

68. A wood working knife for use in a wood working machine comprising:

a knife body having at least one cutting edge, an opposite side to said cutting edge, and opposed first and second clamping surfaces;

the first clamping surface having opposed clamping features separated by a central smooth uninterrupted non load bearing middle section and said clamping features having surface portions which face each other and are opposing inclined surfaces.

69. A wood working knife for use in a wood working machine comprising:

a knife body having at least one cutting edge, an opposite side to said cutting edge, and opposed first and second clamping surfaces;

the first clamping surface having opposed spaced clamping features separated by a central non load bearing middle section and said clamping having surface portions which face each other and are opposing inclined surfaces, whereby when said knife is placed in a knife clamping assembly substantially all of the clamping force applied to said first clamping surface is applied to said clamping features.

70. A wood working knife for use in a wood working machine comprising:

a knife body having at least one cutting edge, an opposite side to said cutting edge, and opposed first and second clamping surfaces;

the first clamping surface having opposed spaced clamping features separated by a central smooth uninterrupted middle section; said spaced clamping features having surface portions which face each other and are opposing inclined surfaces, whereby when said knife is placed in a knife clamping assembly at least 80 percent of the clamping force applied to said first clamping surface is applied to said clamping features.

71. A knife and clamping assembly comprising a wood working knife for use in a wood working machine, said knife having:

a knife body including a first cutting edge, an opposed second edge, a first clamping surface and a second opposed clamping surface;

said first clamping surface having opposed spaced clamping and locating features separated by a middle section;

and a clamping assembly including first and second clamping components for respectively engaging said first and second clamping surfaces;

said opposed clamping and locating features, said clamping components and said middle section of the knife being configured relative to each other such that the clamping and locating forces exerted by the first clamping component engaged with the first clamping surface of the knife occur only at said two opposed clamping and locating features to position the knife body in said clamping assembly, and localize the clamping force towards the cutting edges and away from the middle section and wherein said opposed second edge is a cutting edge and the clamping features are concave hollows in the first clamping surface.

72. A knife and clamping assembly comprising a wood working knife for use in a wood working machine, said knife having:

a knife body including a first cutting edge, an opposed second edge, a first clamping surface and a second opposed clamping surface;

said first clamping surface having opposed spaced clamping and locating features separated by a middle section;

and a clamping assembly including first and second clamping components for respectively engaging said first and second clamping surfaces;

said opposed clamping and locating features, said first clamping component and said middle section of the knife being configured relative to each other such that at least 80 percent of the clamping force exerted by the first clamping component engaged with the first clamping surface of the knife occurs at said two opposed clamping and locating features to position the knife body in said clamping assembly, and localize the clamping force towards the cutting edges and away from the middle section and wherein said opposed second edge is a cutting edge and the clamping features are concave hollows in the first clamping surface.

73. A knife and clamping assembly comprising a wood working knife for use in a wood working machine, said knife having:

a knife body including a first cutting edge, an opposed spaced edge, a first clamping surface and a second opposed clamping surface;

said first clamping surface having opposed spaced clamping and locating features separated by a middle section;

and a clamping assembly including first and second clamping components for respectively engaging said first and second clamping surfaces;

said opposed clamping and locating features, said clamping components and said middle section of the knife being configured such that the majority of the clamping force exerted by the first clamping component engaged with the first clamping surface of the knife occurs at said two opposed clamping and locating features to position the knife body in said clamping assembly, and localize the clamping force towards the cutting edges and away from the middle section and wherein said opposed second edge is a cutting edge and the clamping features are concave hollows in the first clamping surface.

74. A knife and clamping assembly comprising a wood working knife for use in a wood working machine, said knife having:

a knife body including a first cutting edge, an opposed second edge, a first clamping surface and a second opposed clamping surface;

said first clamping surface having opposed spaced clamping and locating features separated by a middle section;

and a clamping assembly including first and second clamping components for respectively engaging said first and second clamping surfaces;

said opposed clamping and locating features, said clamping components and said middle section of the knife being configured relative to each other such that the clamping and locating forces exerted by the first clamping component engaged with the first clamping surface of the knife occur only at said two opposed clamping and locating features to position the knife body in said clamping assembly, and localize the clamping force towards the cutting edges and away from the middle section and wherein said opposed second edge is a cutting edge and the clamping features are opposing inclined surfaces.

75. A knife and clamping assembly comprising a wood working knife for use in a wood working machine, said knife having:

a knife body including a first cutting edge, an opposed second edge, a first clamping surface and a second opposed clamping surface;

said first clamping surface having opposed spaced clamping and locating features separated by a middle section;

and a clamping assembly including first and second clamping components for respectively engaging said first and second clamping surfaces;

said opposed clamping and locating features, said first clamping component and said middle section of the knife being configured relative to each other such that at least 80 percent of the clamping force exerted by the first clamping component engaged with the first clamping surface of the knife occurs at said two opposed clamping and locating features to position the knife body in said clamping assembly, and localize the clamping force towards the cutting edges and away from the middle section and wherein said opposed second edge is a cutting edge and the clamping features are opposing inclined surfaces.

76. A knife and clamping assembly comprising a wood working knife for use in a wood working machine, said knife having:

a knife body including a first cutting edge, an opposed spaced edge, a first clamping surface and a second opposed clamping surface;

said first clamping surface having opposed spaced clamping and locating features separated by a middle section;

and a clamping assembly including first and second clamping components for respectively engaging said first and second clamping surfaces;

said opposed clamping and locating features, said clamping components and said middle section of the knife being configured such that the majority of the clamping force exerted by the first clamping component engaged with the first clamping surface of the knife occurs at said two opposed clamping and locating features to position the knife body in said clamping assembly, and localize the clamping force towards the cutting edges and away from the middle section and wherein said opposed second edge is a cutting edge and the clamping features are opposing inclined surfaces.

* * * * *

UNITED STATES PATENT AND TRADEMARK OFFICE

CERTIFICATE OF CORRECTION

PATENT NO. : 7,159,626 B2
APPLICATION NO. : 10/293309
DATED : January 9, 2007
INVENTOR(S) : Sven-Olov Biller et al.

It is certified that error appears in the above-identified patent and that said Letters Patent is hereby corrected as shown below:

ON THE TITLE PAGE [30] FOREIGN APPLICATION PRIORITY DATA ITEM [30]:

--Jan.17, 2002 (CA) . . . . . .2,368,297-- should be inserted.

Signed and Sealed this

Twelfth Day of June, 2007

JON W. DUDAS
*Director of the United States Patent and Trademark Office*